US006304155B1

(12) United States Patent
Fries

(10) Patent No.: US 6,304,155 B1
(45) Date of Patent: Oct. 16, 2001

(54) DOUBLING THE POWER HANDLING CAPACITY OF A CIRCULATOR-BASED ISOLATOR USING HYBRIDS

(75) Inventor: Henry J. Fries, Westfield, MA (US)

(73) Assignee: Thomcast Communications, Inc., Southwick, MA (US)

( * ) Notice: Subject to any disclaimer, the term of this patent is extended or adjusted under 35 U.S.C. 154(b) by 0 days.

(21) Appl. No.: 09/740,940

(22) Filed: Dec. 21, 2000

Related U.S. Application Data

(60) Provisional application No. 60/192,574, filed on Mar. 28, 2000.

(51) Int. Cl.[7] ..... H01P 5/16; H01P 1/36

(52) U.S. Cl. ..... 333/117; 333/1.1; 333/24.2

(58) Field of Search ..... 333/1.1, 24.2, 333/117

(56) References Cited

U.S. PATENT DOCUMENTS 3,622,896 * 11/1971 Pircher ..... 333/1.1 X 4,902,983 * 2/1990 Fujiki et al. ..... 333/109 X

* cited by examiner

*Primary Examiner*—Justin P. Bettendorf

(74) *Attorney, Agent, or Firm*—Rothwell, Figg, Ernst & Manbeck

(57) ABSTRACT

An apparatus for doubling the amount of power that can be safely applied to a circulator-based isolator, which is made up of an input hybrid which receives an RF signal and outputs two divided RF signals, a Y-junction circulator that receives one of the divided RF signals at one of the circulator ports and outputs it at another circulator port, an output hybrid which receives the two divided RF signals, combines them, and sends them on, the output hybrid simultaneously receiving a returned signal, dividing it, and outputting two divided returned signals, one divided returned signal going to the circulator and the other divided returned signal going directly to the input hybrid, a phase retarding circuit which takes the half of the divided returned signal that went back to the circulator and retards its phase by 180 degrees and sends it back to the circulator, where it goes to the input hybrid as well, to be recombined with the other half of the returned signal and attenuated.

14 Claims, 7 Drawing Sheets

10

20

30

DOUBLING THE POWER HANDLING CAPACITY OF A CIRCULATOR-BASED ISOLATOR USING HYBRIDS

CROSS REFERENCE TO RELATED APPLICATION

This application claims priority from provisional application serial no. 60/192,574, filed Mar. 28, 2000.

BACKGROUND OF THE INVENTION

1. Field of the Invention

The present invention relates generally to the isolation of radio frequency (RF) signal amplifiers from returned signals using circulator-based isolators.

2. Background and Related Art

Circulators are generally ferrite devices composed of permanent magnets. Circulators used as isolators pass RF signals and block returned signals. Some of the power in the RF signal, and nearly all of the power in the blocked returned signals, is dissipated as heat. Dissipating power as heat raises the temperature of a circulator. The performance characteristics of ferrite devices composed of permanent magnets change with temperature. In particular, the frequency response of ferrite, and the coercive effect of permanent magnets, changes as temperatures rise. Uncompensated changes in the frequency response of ferrite and the coercive effect of permanent magnets cause a circulator to suffer higher return losses, or "drift", in all of its ports. Drift manifests itself as a change in impedance. Changed impedances cause mis-matched impedances, which cause power to be reflected rather than transferred, which leads to further heating, further losses, and ultimately failure of the circulator. Failure of a circulator means upstream components such as amplifiers are no longer being isolated from returned signals, which jeopardizes their lives as well.

In general, the higher the temperature a circulator is able to withstand, the higher its rated power level. Circulators used as isolators are normally temperature-compensated to increase the temperature they are able to tolerate. Temperature compensation is costly. Higher operating temperatures, and hence higher rated power levels, may be achieved in return for higher cost and greater complexity. Still, there is a finite limit to the amount of power that can be passed safely through any circulator-based isolator.

SUMMARY OF THE INVENTION

The present invention provides a solution to the shortcomings of the prior art as discussed above.

In particular, the present invention provides an apparatus for doubling the amount of power that can be safely applied to a circulator-based isolator, which is made up of an input hybrid which receives an RF signal and outputs two divided RF signals, a circulator that receives one of the divided RF signals at one of the circulator ports and outputs it at another circulator port, an output hybrid that receives the two divided RF signals, combines them, and sends them on, an output hybrid that simultaneously receives a returned signal, divides it, and outputs two divided returned signals, one divided returned signal going to the circulator and the other divided returned signal going directly to the input hybrid, and a phase retarding circuit that takes the one-half of the divided returned signal that went back to the circulator and retards its phase by 180 degrees and sends it back to the circulator, where it goes to the input hybrid as well, to be recombined with the other half of the returned signal and there attenuated.

DESCRIPTION OF THE DRAWINGS

The invention will be described in detail with reference to the following drawings, in which.

DETAILED DESCRIPTION OF PREFERRED EMBODIMENTS

Figure 1:
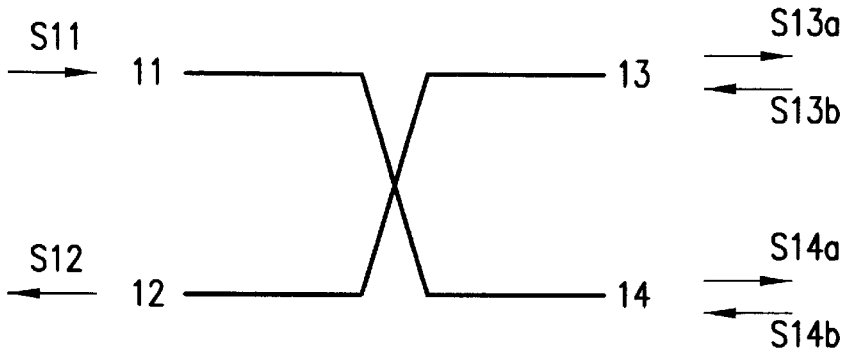
FIG. 1 is a schematic diagram of a hybrid junction used in connection with the present invention.

FIG. 1 is a schematic representation of a conventional device 10 known alternatively as a hybrid, quadrature hybrid, hybrid junction, π- hybrid, "magic tee", or cross-coupled hybrid of the coaxial type. A hybrid junction is generally a four port waveguide or strip line structure having four terminals or ports so arranged that, when properly terminated in external impedances, an RF signal input at port 11 will be coupled to ports 13 and 14, but not to port 12. Furthermore, the signal at port 14 will be in quadrature with the signal at port 13. Similarly, an RF signal input port 12 will be coupled to ports 13 and 14 (assuming proper load impedances) but not to port 11. And in that case the signal at port 13 will be in quadrature with the signal at port 14. In particular, an RF signal S11 entering hybrid 10 at port 11 will divide and emerge from the two opposite ports 13 and 14 as two output signals S13*a* and S14*a*, with S14*a* in quadrature with S13*a*, assuming that ports 13 and 14 are terminated with appropriate equal characteristic impedances, but will be unable to reach the adjacent port 12. Conversely, if signals S13*b* and S14*b*, where S14*b* is in quadrature with S13*b*, enter hybrid 10 at ports 13 and 14, respectively, the signals will be recombined as a single signal S12 at port 12. It is important to note that the signals S13*b* and S14*b* will be recombined and output from port 12 rather than port 11 because signal S14*b* is in quadrature with signal S13*b*. Hybrids with phase relationships other than quadrature can be substituted and configured to similarly split and combine the signal as will be known to people skilled in the art. Examples of known hybrid junctions are disclosed, for example, in U.S. Pat. Nos. 3,818,385 and 4,413,242. The term "hybrid" as used hereinafter shall include a hybrid, hybrid junction, or other equivalent coupler and/or splitter device as known in the art.

Figure 2:
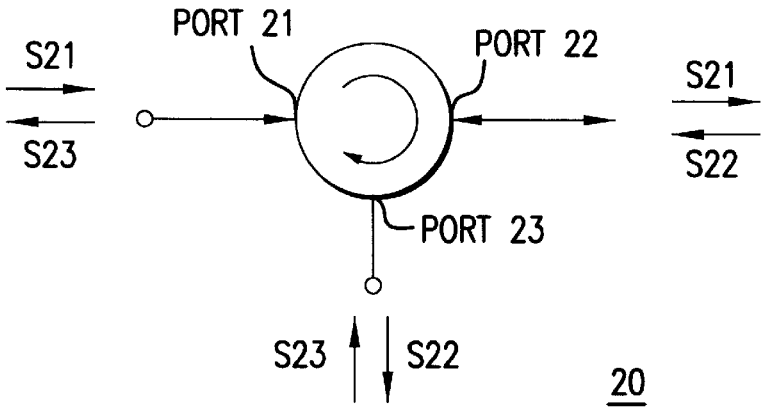
FIG. 2 is a schematic diagram of a Y-junction circulator used in connection with the present invention.

FIG. 2 is a schematic representation of a particular form of hybrid known as a circulator 20. This particular form of circulator 20 is known as a Y-junction circulator because it has three ports. In general, however, a circulator may have more than three ports. Circulator 20 is a three port waveguide or transmission line structure having three terminals or ports so arranged that, when properly terminated in external impedances, an RF signal entering circulator 20 at any given port will emerge from the nearest port in the clockwise direction, but will be unable to reach the nearest port in the counter-clockwise direction. In particular, an RF input signal S21 entering circulator 20 at port 21 will be coupled to port 22, but not to port 23. Similarly, an RF input signal S22 entering circulator 20 at port 22 will be coupled to port 23, but not to port 21. And an RF input signal S23 entering circulator 20 at port 23 will be coupled to port 21, but not to port 22. Although a clockwise signal rotation was assumed for the above description, a circulator having a counter-clockwise signal rotation would work in an analogous manner.

Figure 3:
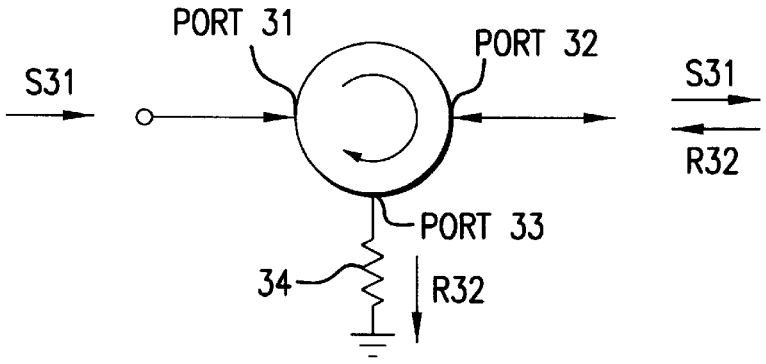
FIG. 3 is a schematic diagram of the Y-junction circulator shown in FIG. 2 configured as an isolator.

FIG. 3 is a schematic representation of a circulator 30 being used as an isolator. In this case port 33 is terminated with a matched impedance 34. An RF input signal S31 entering circulator 30 at port 31, that is, in the forward direction, will be coupled to port 32 and emerge. A returned signal R32 entering circulator 30 at port 32, on the other hand, will be coupled to port 33 and then be completely attenuated by matched impedance 34. A device connected to port 31 of circulator 30 is thus isolated from a returned signal R32 appearing at port 32.

Figure 4:
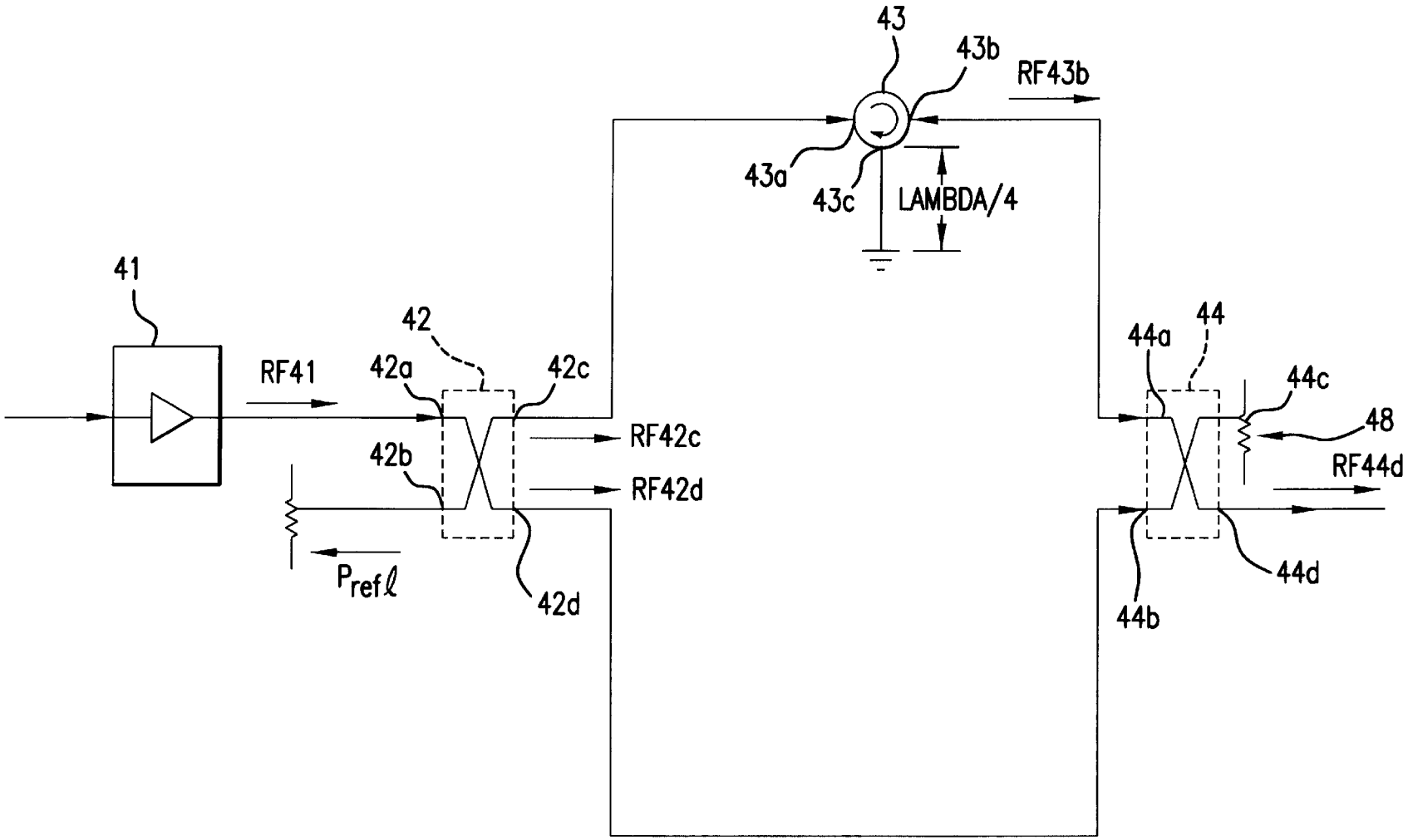
FIG. 4 is a block diagram of the forward signal path of a first embodiment of a circulator-based isolator power capacity doubling apparatus according to the present invention.

FIG. 4 shows the forward signal path of a first embodiment of the circulator-based isolator power capacity doubling apparatus according to the present invention. In FIG. 4, RF signal RF41 from an input device 41 which may be, for example, an amplifier, enters input hybrid 42 at first hybrid port 42*a* of input hybrid 42 and is divided, with one-half of signal RF41 emerging at third hybrid port 42*c* of input hybrid 42 as signal RF42*c*, while the other half of signal RF41 emerges at fourth hybrid port 42*d* of input hybrid 42 as signal RF42*d*. Signal RF42*d* is in quadrature with signal RF42*c*. Signal RF42*c* enters circulator 43 at first circulator port 43*a* of circulator 43 and emerges from second circulator port 43*b* of circulator 43 as signal RF43*b*. In a preferred embodiment circulator 43 is a Y-junction circulator but a circulator with more than three ports could be used as well by appropriately terminating the unused ports. RF43*b* then enters output hybrid 44 at second hybrid port 44*a* of output hybrid 44. Signal RF42*d*, meanwhile, bypasses circulator 43 and is input directly to second hybrid port 44*b* of output hybrid 44. Signal RF43*b* is then recombined with signal RF42*d* in output hybrid 44 and emerges at fourth hybrid port 44*d* of output hybrid 44 as signal RF44*d*. Signal RF44*d* is then transmitted to an output load which may be, for example, an antenna. Circulator 43 thus sees only half of the forward signal power. Hybrid port 44*c* of output hybrid 44 is terminated with matched impedance 48. Circulator port 43*c* of circulator 43 is terminated with an appropriate impedance, as described below.

Figure 5:
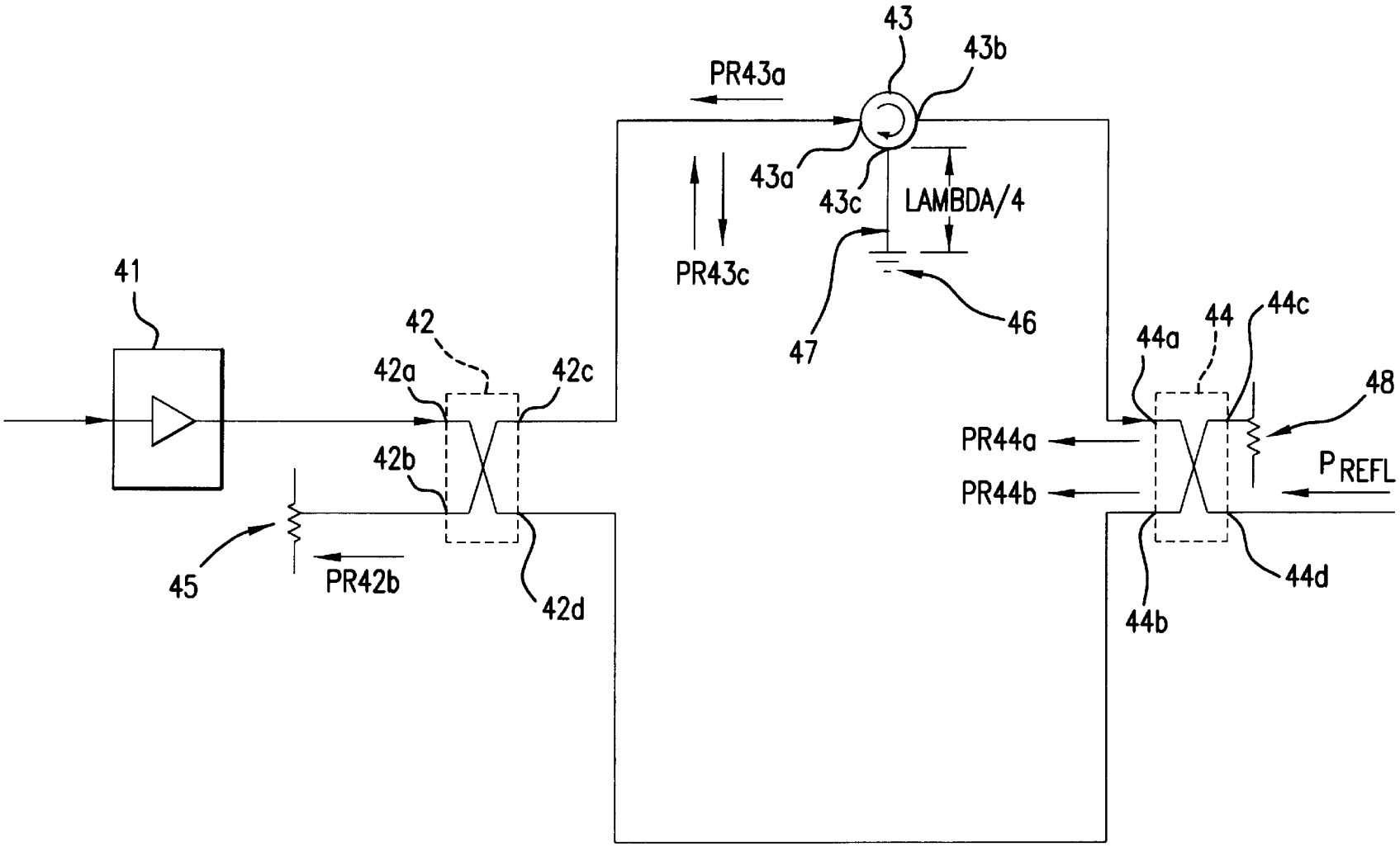
FIG. 5 is a block diagram of the reverse signal path of the embodiment of a circulator-based isolator power capacity doubling apparatus shown in FIG. 4.

FIG. 5 shows the reverse signal path of the first embodiment of the circulator-based isolator power capacity doubling apparatus according to the present invention that was shown in FIG. 4. The returned signal $P_{REFL}$ returns to output hybrid 44 at fourth hybrid port 44*d* of output hybrid 44. Returned signal $P_{REFL}$ is divided by output hybrid 44, with one-half of returned signal $P_{REFL}$ emerging from first hybrid port 44*a* of output hybrid 44 as returned signal PR44*a* while the other half of returned signal $P_{REFL}$ emerges from second hybrid port 44*b* of output hybrid 44 as returned signal PR44*b*. Returned signal PR44*a* is in quadrature with returned signal PR44*b*. Returned signal PR44*a* enters circulator 43 at second circulator port 43*b* of circulator 43 and is circulated to third circulator port 43*c* of circulator 43, where it emerges as returned signal PR43*c*. Returned signal PR43*c* then travels down quarter-wavelength stub 47. Quarter-wavelength stub 47 is preferably a transmission line with an electrical length equal to one-quarter of the wavelength of the RF input signal RF41 (shown in FIG. 4), but its electrical length may be any odd multiple of one-quarter of the wavelength of the RF input signal RF41 as will be known to persons skilled in the art. The phase angle of returned signal PR43*c* will thus be retarded 90 degrees over the course of quarter-wavelength stub 47. The phase angle of returned signal PR43*c* is thus approximately the same as the phase angle of returned signal PR44*b* after traversing quarter-wavelength stub 47. Quarter-wavelength stub 47 is terminated by short circuit (ground) 46. Returned signal PR43*c* is thus reflected by the impedance mis-match of short circuit (ground) 46 and re-traverses quarter-wavelength stub 47 to third circulator port 43*c*, retarding the phase angle of returned signal PR43*c* a further 90 degrees along the way. Quarter-wavelength stub 47 and short circuit (ground) 46 thus retard the phase angle of returned signal PR43*c* a total of 180 degrees. The phase angle of returned signal PR43*c* is now approximately 90 degrees behind the phase angle of returned signal PR44*b*. Thus returned signal PR44*b* is now in quadrature with returned signal PR43*c*. Returned signal PR43*c* is circulated to first circulator port 43*a* of circulator 43 where it emerges as returned signal PR43*a* and enters input hybrid 42 at third hybrid port 42*c* of input hybrid 42. Returned signal PR44*b*, in contrast, bypasses circulator 43 and is input directly to fourth hybrid port 42*d* of input hybrid 42. Circulator 43 thus sees only half of returned signal $P_{REFE}$. Returned signal PR43*a*, which entered input hybrid 42 at third hybrid port 42*c* of input hybrid 42, recombines with returned signal PR44*b* entering input hybrid 42 at fourth hybrid port 42*d* of input hybrid 42, and emerges from input hybrid 42 at second hybrid port 42*b* of input hybrid 42 as returned signal PR42*b*. Returned signal PR42*b* exits input hybrid 42 at second hybrid port 42*b* of input hybrid 42 and not first hybrid port 42*a* of input hybrid 42 because returned signal PR44*b* is now in quadrature with returned signal PR43*a*. Second hybrid port 42*b* of input hybrid 42 is terminated with matched impedance 45, thus completely attenuating returned signal PR42*b*. The input load attached to first hybrid port 42*a* of input hybrid 42 thus sees none of the returned signal $P_{REFL}$. Since circulator 43 sees only half of the forward signal and half of the returned signal, the input load can be doubled.

Figure 6:
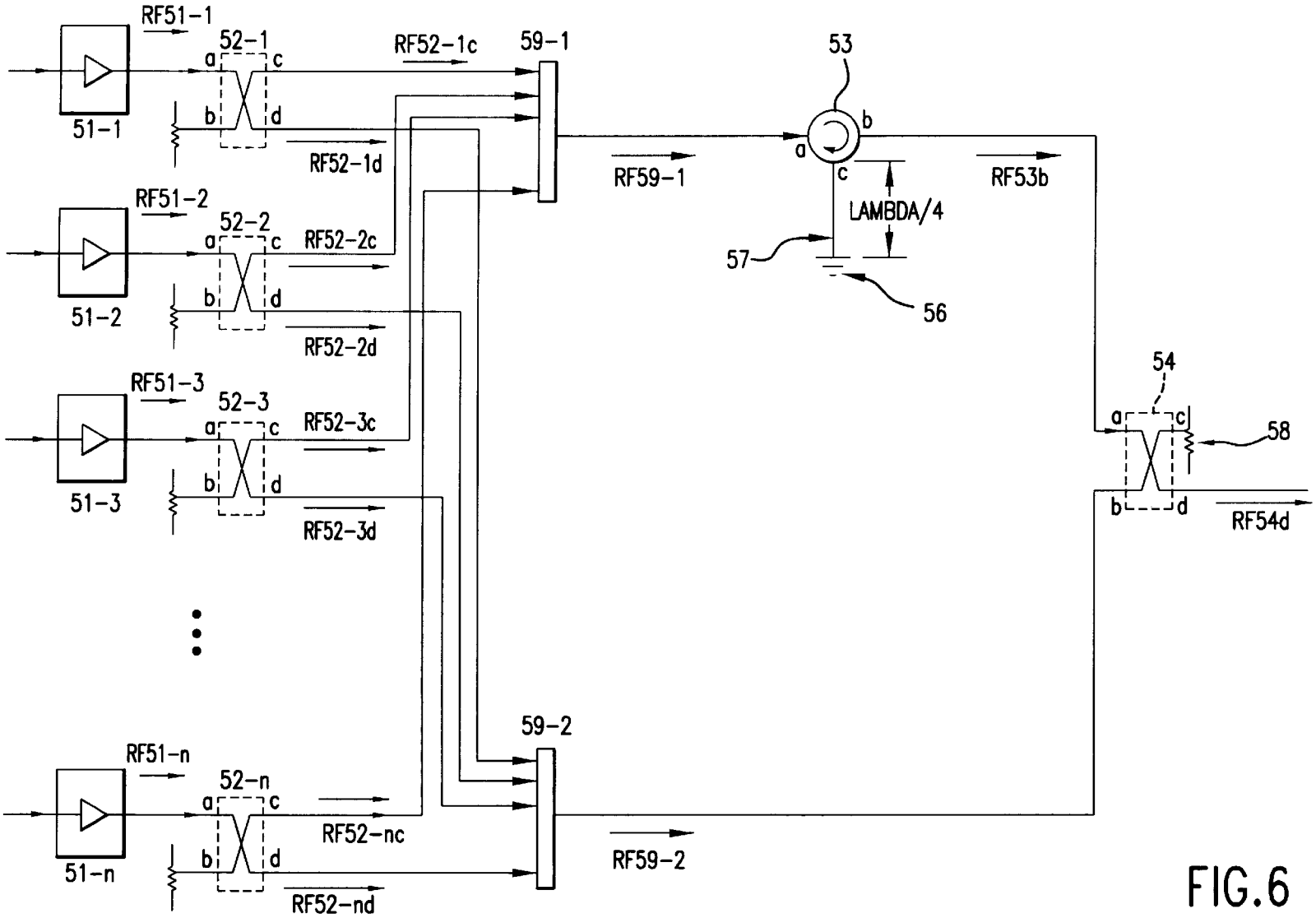
FIG. 6 is a block diagram of the forward signal path of a second embodiment of a circulator-based isolator power capacity doubling apparatus according to the present invention.

In FIG. 6 is shown the forward signal path of a second embodiment of the circulator-based isolator power capacity doubling apparatus according to the present invention. The second embodiment is generally the concept of the first embodiment that was shown in FIGS. 4 and 5, extended to a plurality of input devices. RF signals RF51-1, RF51-2, RF51-3, . . . RF51-n from input devices 51-1, 51-2, 51-3, . . . 51-n, respectively, enter hybrids 52-1, 52-2, 52-3, . . . 52-n at first hybrid ports 52-1*a*, 52-2*a*, 52-3*a* . . . 52-na, respectively, where they are divided into signals RF52-1*c*, RF52-2*c*, RF52-3*c* . . . RF52-nc and signals RF52-1*d*, RF52-2*d* , RF52-3*d* . . . RF52-nd. Signals RF52-l*d*, RF52-2*d*, RF52-3*d* . . . RF52-nd are in quadrature with signals RF52-1*c*, RF52-2*c*, RF52-3*c* . . . RF52-nc, respectively. Signals RF52-1*c* , RF52-2*c*, RF52-3*c* . . . RF52-nc are multiplexed in multiplexer 59-1, forming signal RF59-1, while signals RF52-1*d*, RF52-2*d*, RF52-3*d* . . . RF52-nd are multiplexed in multiplexer 59-2, forming signal RF59-2. Multiplexers 59-1 and 59-2 can be time, frequency, or code division multiplexers, or any equivalent type of signal combination means, such that the multiplexed signals can also be de-multiplexed. Signal RF59-2 is in quadrature with signal RF59-1. Signal RF59-1 enters first circulator 53 at port 53*a* of circulator 53 and emerges from second circulator port 53*b* of circulator 53 as signal RF53*b*. In this embodiment circulator 53 is a Y-junction circulator but a circulator with more than three ports could be used as well by appropriately terminating the unused ports. Signal RF53*b* then enters output hybrid 54 at first hybrid port 54*a* of output hybrid 54. Signal RF59-2, meanwhile, bypasses circulator 53 and is input directly to second hybrid port 54*b* of output hybrid 54. Signal RF53*b* then recombines with signal RF59-2 in output hybrid 54 and emerges from fourth hybrid port 54*d* of output hybrid 54 as signal RF54*d*. Signal RF54*d* is then transmitted to an output load which may, for example, be an antenna. The circulator 53 thus sees only half of the forward power. Third hybrid port 54*c* of output hybrid 54 is terminated with matched impedance 58. Circulator port 53*c* of circulator 53 is terminated with an appropriate impedance, as described below.

Figure 7:
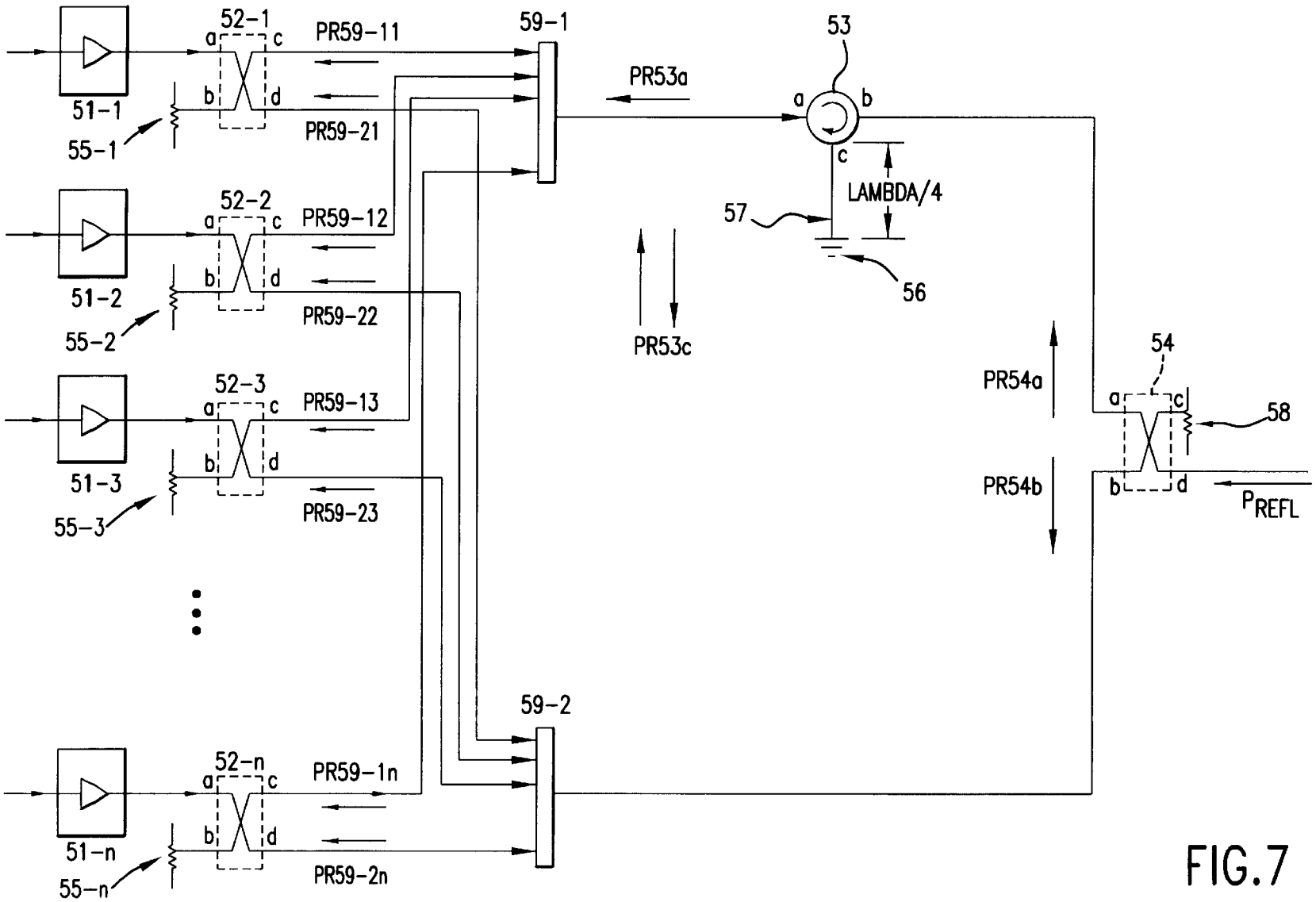
FIG. 7 is a block diagram of the reverse signal path of the embodiment of a circulator-based isolator power capacity doubling apparatus shown in FIG. 6.

In FIG. 7 is shown the reverse signal path of the second embodiment of the circulator-based isolator power capacity doubling apparatus according to the present invention that was shown in FIG. 6. Returned signal $P_{REFL}$ returns to output hybrid 54 at fourth hybrid port 54*d* of output hybrid 54. Returned signal $P_{REFL}$ is divided by output hybrid 54, with one-half of returned signal $P_{REFL}$ emerging from first hybrid port 54*a* of output hybrid 54 as returned signal PR54*a* while the other half of returned signal $P_{REFL}$ emerges from second hybrid port 54*b* of output hybrid 54 as returned signal PR54*b*. Returned signal PR54*a* is in quadrature with returned signal PR54*b*. Returned signal PR54*a* enters circulator 53 at second circulator port 53*b* of circulator 53 and is circulated to third circulator port 53*c* of circulator 53, where it emerges as PR53*c*. Returned signal PR53*c* then travels down quarter-wavelength stub 57. The electrical length of quarter-wavelength stub 57 is preferably equal to one-quarter of the wavelength of the RF input signals RF51-1, RF51-2, RF51-3 . . . RF51-n (shown in FIG. 6), but it may be any odd multiple of one-quarter of the wavelength of the RF input signals RF51-1, RF51-2, RF51-3 . . . RF51-n as will be known to persons skilled in the art. The phase angle of returned signal PR53*c* is thus retarded 90 degrees over the course of quarter-wavelength stub 57. The phase angle of returned signal PR53*c* is thus approximately the same as the phase angle of returned signal PR54*b* after traversing quarter-wavelength stub 57. Quarter-wavelength stub 57 is terminated by short circuit (ground) 56. Returned signal PR53*c* is thus reflected by the impedance mis-match of short circuit (ground) 56 and re-traverses quarter-wavelength stub 57 back to third circulator port 53*c* of circulator 53, retarding the phase angle of returned signal PR53*c* a further 90 degrees along the way. Quarter-wavelength stub 57 and short circuit (ground) 56 thus retard the phase angle of returned signal PR53*c* a total of 180 degrees. Returned signal PR54*b* is now in quadrature with returned signal PR53*c*. Returned signal PR53*c* is circulated to first circulator port 53*a* of circulator 53 where it emerges as returned signal PR53*a* and is input to multiplexer 59-1. Multiplexer 59-1 de-multiplexes returned signal PR53*a* into returned signals PR59-11, PR59-12, PR59-13, . . . PR59-1*n*. Returned signals PR59-11, PR59-12, PR59-13, . . . PR59-1*n* enter input hybrids 52-1, 52-2, 52-3, . . . 52-n at third hybrid ports 52-1*c*, 52-2*c*, 52-3*c*, . . . 52-nc, respectively. Returned signal PR54*b*, in contrast, bypasses circulator 53 and enters multiplexer 59-2, where it is de-multiplexed into returned signals PR59-21, PR59-22, PR59-23, . . . PR59-2*n*. Returned signals PR59-21, PR59-22, PR59-23, . . . PR59-2*n* then enter fourth hybrid ports 52l*d*, 52-2*d*, 52-3*d*, . . . 52-nd, respectively. Circulator 53 thus sees only half of returned signal PREFL. Returned signals PR59-11, PR59-12, PR59-13, . . . PR59-1*n*, which entered input hybrids 52-1, 52-2, 52-3, . . . 52-n at third hybrid ports 52-1*c*, 52-2*c*, 52-3*c*, . . . 52-nc, respectively, recombine with returned signals PR59-21, PR59-22, PR59-23, . . . PR59-2*n* entering input hybrids 52-1, 52-2, 52-3, . . . 52-n at fourth hybrid ports 52-1*d*, 52-2*d*, 523*d*, . . . 52-nd, respectively, and emerge from input hybrids 52-1, 52-2, 52-3, . . . 52-n at second hybrid ports 52-1*b*, 52-2*b*, 52-3*b*, . . . 52-nb as returned signals PR52-1*b*, PR52-2*b*, PR52-3b, . . . PR52-nb, respectively. Returned signals PR521*b*, PR52-2*b*, PR52-3*b*, . . . PR52-nb exit input hybrids 52-1, 52-2, 52-3, . . . 52-n at second hybrid ports 52-1*b*, 52-2*b*, 52-3*b*, . . . 52-nb and not first hybrid ports 52-l*a*, 52-2*a*, 52-3*a*, . . . 52-na because returned signals PR59-21, PR59-22, PR59-23, . . . . PR59-2*n* are in quadrature with returned signals PR59-11, PR59-12, PR59-13, . . . PR59-1*n*. Second hybrid ports 52-1*b*, 52-2*b*, 52-3*b*, . . . . 52-nb are each terminated with matched impedances 55-1, 55-2, 55-3, . . . 55-n, respectively, thus completely attenuating returned signals PR52-1*b*, PR52-2*b*, PR52-3*b*, . . . PR52-nb. The input loads 51-1, 51-2, 51-3, . . . . 51-n attached to first hybrid ports 52-l*a*, 52-2*a*, 52-3*a*, . . . 52-na, respectively, thus see none of the returned signal $P_{REFL}$. Since circulator 53 sees only half of the forward signal and half of the returned signal, the input load can be doubled.

Figure 8:
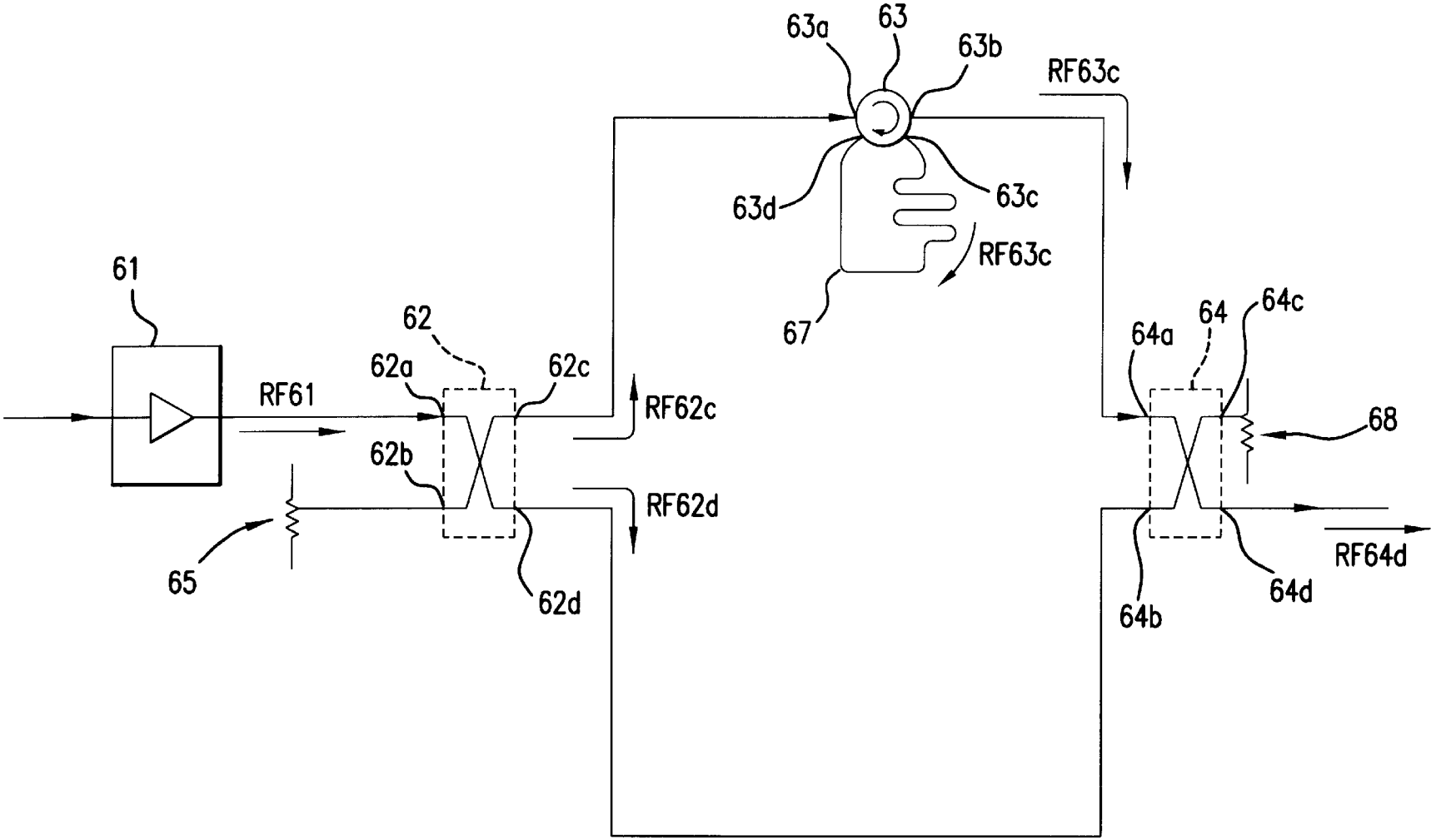
FIG. 8 is a block diagram of the forward signal path of a third embodiment of a circulator-based isolator power capacity doubling apparatus according to the present invention.

FIG. 8 shows the forward signal path of a third embodiment of the circulator-based isolator power capacity doubling apparatus according to the present invention. In FIG. 8, RF signal RF61 from an input device 61 which may be, for example, an amplifier, enters input hybrid 62 at first hybrid port 62*a* of input hybrid 62 and is divided, with one-half of signal RF61 emerging at third hybrid port 62*c* of input hybrid 62 as signal RF62*c* while the other half of signal RF61 emerges at fourth hybrid port 62*d* of input hybrid 62 as signal RF62*d*. Signal RF62*d* is in quadrature with signal RF62*c*. Signal RF62*c* enters circulator 63 at first circulator port 63*a* of circulator 63 and emerges from second circulator port 63*b* of circulator 63 as signal RF63*b*. In this embodiment circulator 63 is a four-port circulator but a circulator with more than four ports could be used as well by appropriately terminating the unused ports. RF63*b* then enters output hybrid 64 at second hybrid port 64*a* of output hybrid 64. Signal RF62*d*, meanwhile, bypasses circulator 63 and is input directly to second hybrid port 64*b*. Signal RF63*c* is then recombined with signal RF62*d*and emerges at fourth hybrid port 64*d* of output hybrid 64 as signal RF64*d*. Signal RF64*d* is then transmitted to an output load which may be, for example, an antenna. The circulator 63 thus sees only half of the forward signal power. Third hybrid port 64*c* of output hybrid 64 is terminated with matched impedance 68. Third circulator port 63*c* and fourth circulator port 63*d* of circulator 63 and are each terminated with appropriate impedances, as described below.

Figure 9:
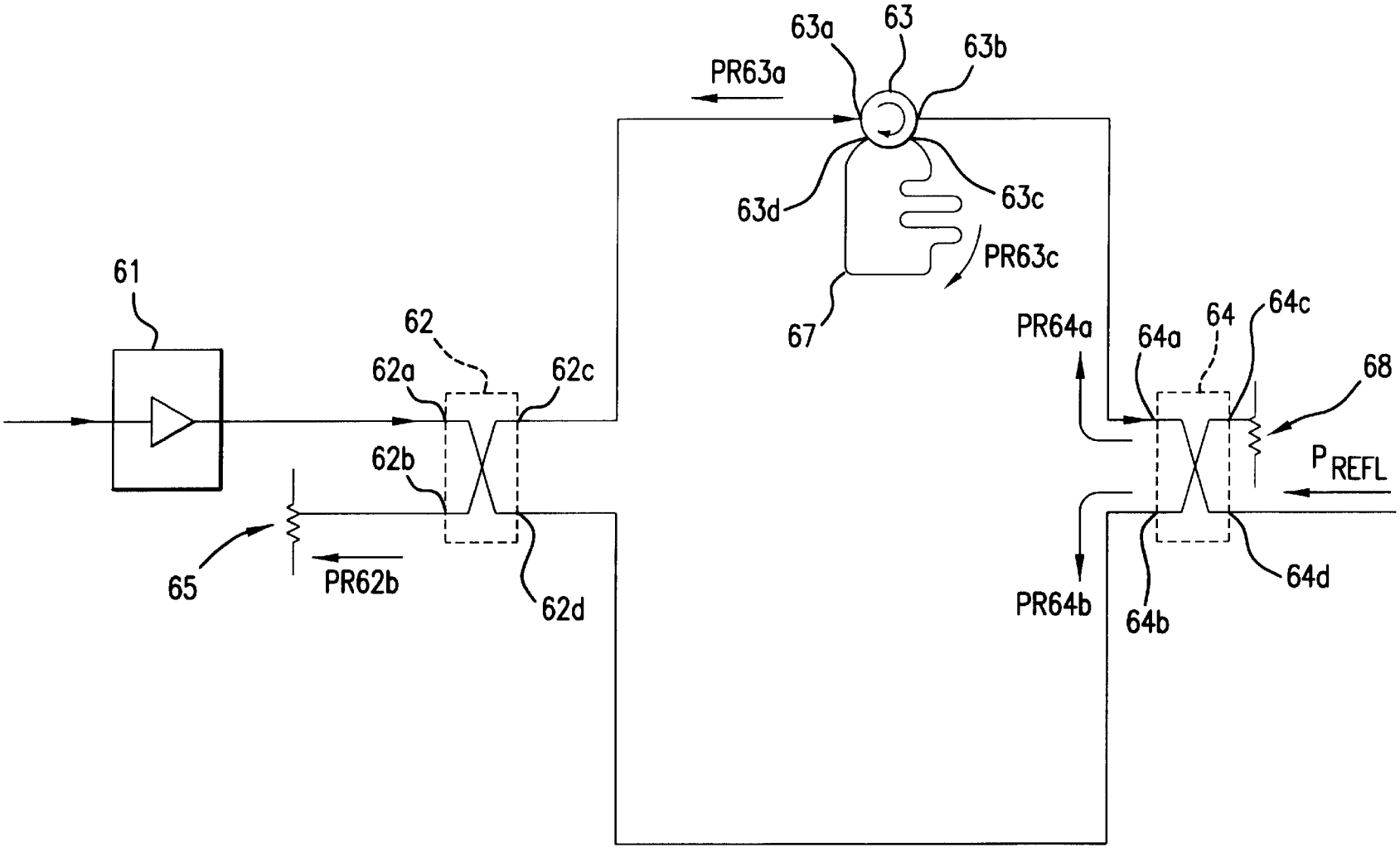
FIG. 9 is a block diagram of the reverse signal path of the embodiment of a circulator-based isolator power capacity doubling apparatus shown in FIG. 8.

FIG. 9 shows the reverse signal path of the third embodiment of the circulator-based isolator power capacity doubling apparatus that was shown in FIG. 8. In FIG. 9, the returned signal $P_{REFL}$ returns to output hybrid 64 at fourth hybrid port 64*d* of output hybrid 64. Returned signal $P_{RELF}$ is divided by output hybrid 64, with one-half of returned signal $P_{REFL}$ emerging from first hybrid port 64*a* of output hybrid 64 as returned signal PR64*a* while the other half of returned signal $P_{REFL}$ emerges from second hybrid port 64*b* of output hybrid 64 as returned signal PR64*b*. Returned signal PR64*a* is in quadrature with returned signal PR64*b*. Returned signal PR64*a* enters circulator 63 at second circulator port 63*b* of circulator 63 and is circulated to third circulator port 63*c* of circulator 63, where it emerges as returned signal PR63*c*. Returned signal PR63*c* then travels down half-wavelength transmission line 67 to fourth circulator port 63*d* of circulator 63. Half-wavelength transmission line 67 is preferably a transmission line with an electrical length equal to one-half of the wavelength of the RF input signal RF61 (shown in FIG. 8). The phase angle of returned signal PR63*c* is thus retarded 180 degrees over the course of half-wavelength transmission line 67. The phase angle of returned signal PR63*c* is thus approximately 90 degrees behind the phase angle of returned signal PR64*b* when it re-enters circulator 63 at third circulator port 63*d* of circulator 63. Thus returned signal PR64*b* is now in quadrature with PR63*c*. Returned signal PR63*c* is circulated to first circulator port 63*a* of circulator 63 where it emerges as returned signal PR63*a* and enters input hybrid 62 at third hybrid port 62*c* of input hybrid 62. Returned signal PR64*b*, in contrast, bypasses circulator 63 and is input directly to fourth hybrid port 62*d* of input hybrid 62. Circulator 63 thus sees only half of returned signal $P_{REFL}$ Returned signal PR63*a*, which entered input hybrid 62 at third hybrid port 62*c* of input hybrid 62, recombines with returned signal PR64*b* entering input hybrid 62 at fourth hybrid port 62*d* of input hybrid 62, and emerges from input hybrid 62 at second hybrid port 62*b* of input hybrid 62 as returned signal PR62*b*. Returned signal PR62*b* exits input hybrid 62 at second hybrid port 62*b* of input hybrid 62 and not first hybrid port 62*a* of input hybrid 62 because returned signal PR63*a* is in quadrature with returned signal PR64*b*. Second hybrid port 62*b* of input hybrid 62 is terminated with matched impedance 65, thus completely attenuating returned signal PR62*b*. The input load attached to first hybrid port 62*a* of input hybrid 62 thus sees none of the returned signal $P_{REFL}$ Since circulator 63 sees only half of the forward signal and half of the returned signal, the input load can be doubled. The third embodiment can be extended to multiple input devices in the manner of the second embodiment.

The invention having been thus described, it will be apparent to those skilled in the art that the same may be varied in many ways without departing from the spirit and scope of the inventions. All such modifications are intended to be encompassed by the following claims.

What is claimed is:

1. An apparatus for doubling the power capacity of a circulator-based isolator, comprising:

an input hybrid with a first, second, third, and fourth input hybrid ports;

said input hybrid receiving an RF signal at said first input hybrid port and outputting first and second divided RF signals at said third and fourth input hybrid ports;

a first matched impedance terminating said second input hybrid port;

a circulator with a first, second and third circulator ports;

said circulator receiving said first divided RF signal at said first circulator port and outputting said first divided RF signal at said second circulator port;

an output hybrid with a first, second, third, and fourth output hybrid ports;

a second matched impedance terminating said third output hybrid port;

said output hybrid receiving said first divided RF signal at said first output hybrid port and said second divided RF signal at said second output hybrid port and outputting a recombined RF signal at said fourth output hybrid port;

said output hybrid receiving a returned signal at said fourth output hybrid port and outputting a first divided returned signal at said first output hybrid port and a second divided returned signal at said second output hybrid port;

phase retarding means for retarding the phase of said first divided returned signal by 180 degrees and outputting a phase-shifted first divided returned signal;

said circulator receiving said first divided returned signal at said second circulator port and outputting said first divided returned signal at said third circulator port to said phase retarding means;

said circulator receiving said phase-shifted first divided returned signal from said phase retarding means at said third circulator port and outputting said phaseshifted first divided returned signal at said first circulator port;

wherein said third input hybrid port receives the phase-shifted first divided returned signal;

said fourth input hybrid port receives said second divided returned signal; and said phase-shifted first divided returned signal and said second divided returned signals recombine in said second input hybrid port and are attenuated by said first matched impedance.

2. The apparatus of claim 1, wherein:

said phase retarding means is a stub terminated by a mis-matched impedance attached to said third circulator port.

3. The apparatus of claim 2, wherein:

said mis-matched impedance is a short circuit.

4. The apparatus of claim 2, wherein:

the electrical length of said stub is an odd multiple of one-quarter of the wavelength of said RF signal.

5. The apparatus of claim 2, wherein:

said odd multiple is one.

6. An apparatus for doubling the power capacity of a circulator-based isolator, comprising:

a plurality of input hybrids, each with a first, second, third, and fourth input hybrid ports;

said plurality of input hybrids receiving RF signals at each of said first input hybrid ports and outputting a first and second divided RF signals at each of said third and fourth input hybrid ports;

a plurality of first matched impedances terminating each of said second input hybrid ports;

a first multiplexer multiplexing each of said first divided RF signals into a first multiplexed signal;

a second multiplexer multiplexing each of said second divided RF signals into a second multiplexed signal;

a circulator with a first, second and third circulator ports;

said circulator receiving said first multiplexed RF signal at said first circulator port and outputting said first multiplexed RF signal at said second circulator port;

an output hybrid with a first, second, third, and fourth output hybrid ports;

a second matched impedance terminating said third output hybrid port;

said output hybrid receiving said first multiplexed RF signal from said circulator at said first output hybrid port and said second multiplexed RF signal at said second output hybrid port and outputting a recombined RF signal at said fourth output hybrid ports;

said output hybrid receiving a returned signal at said fourth output hybrid port and outputting a first divided returned signal at said first output hybrid port and a second divided returned signal at said second output hybrid port;

phase retarding means for retarding the phase of said first divided returned signal by 180 degrees and outputting a phase-shifted first divided returned signal;

said circulator receiving said first divided returned signal at said second circulator port and outputting said first divided returned signal at said third circulator port to said phase retarding means;

said circulator receiving said phase-shifted first divided returned signal from said phase retarding means at said third circulator port and outputting said phaseshifted first divided returned signal at said first circulator port;

said first multiplexer demultiplexing said phaseshifted first divided returned signal and outputting a plurality of phase-shifted first demultiplexed signals;

said second multiplexer demultiplexing said second divided returned signal and outputting a plurality of second demultiplexed signals;

wherein each of said third input hybrid ports receives one of said phase-shifted first demultiplexed returned signals;

each of said fourth input hybrid ports receives one said second demultiplexed returned signal; and each of said phase-shifted first demultiplexed returned signals and each of said second demultiplexed returned signals recombine in each of said second input hybrid ports and are attenuated by each of said first matched impedances.

7. The apparatus of claim 6, wherein:

said phase retarding means is a stub terminated by a mis-matched impedance attached to said third circulator port.

8. The apparatus of claim 6, wherein:

said mis-matched impedance is a short circuit.

9. The apparatus of claim 6, wherein:

the electrical length of said stub is an odd multiple of one-quarter of the wavelength of said RF signal.

10. The apparatus of claim 9, wherein:

said odd multiple is one.

11. An apparatus for doubling the power capacity of a circulator-based isolator, comprising:

an input hybrid with a first, second, third, and fourth input hybrid ports;

said input hybrid receiving an RF signal at said first input hybrid port and outputting first and second divided RF signals at said third and fourth input hybrid ports;

a first matched impedance terminating said second input hybrid port;

a circulator with a first, second, third and fourth circulator ports;

said circulator receiving said first divided RF signal at said first circulator port and outputting said first divided RF signal at said second circulator port;

an output hybrid with a first, second, third, and fourth output hybrid ports;

a second matched impedance terminating said third output hybrid port;

said output hybrid receiving said first divided RF signal at said first output hybrid port and said second divided RF signal at said second output hybrid port and outputting a recombined RF signal at said fourth output hybrid ports;

said output hybrid receiving a returned signal at said fourth output hybrid port and outputting a first divided returned signal at said first output hybrid port and a second divided returned signal at said second output hybrid port;

phase retarding means for retarding the phase of said first divided returned signal by 180 degrees and outputting a phase-shifted first divided returned signal;

said circulator receiving said first divided returned signal at said second circulator port and outputting said first divided returned signal at said third circulator port to said phase retarding means;

said circulator receiving said phase-shifted first divided returned signal from said phase retarding means at said fourth circulator port and outputting said phase-shifted first divided returned signal at said first circulator port;

wherein said third input hybrid port receives the phase-shifted first divided returned signal;

said fourth input hybrid port receives said second divided returned signal; and said phase-shifted first divided returned signal and said second divided returned signals recombine in said second input hybrid port and are attenuated by said first matched impedance.

12. The apparatus of claim 11, wherein:

said phase retarding means comprises a transmission line connected between said third circulator port and said fourth circulator port.

13. The apparatus of claim 11, wherein:

the electrical length of said transmission line is one-half of the wavelength of said RF signal.

14. An apparatus for doubling the power capacity of a circulator-based isolator, comprising:

an input hybrid which receives an RF input signal and outputs a pair of RF output signals in quadrature;

an output hybrid which receives a pair of RF input signals in quadrature and outputs a combined RF output signal to a load device; and a circulator which receives one of said RF output signals in quadrature from said input hybrid and outputs it to said output hybrid, and also receives a first quadrature returned signal from said load device through said output hybrid, and sends said first quadrature returned signal to phase modification means, which modifies the phase of said first quadrature returned signal relative to a second quadrature returned signal from said load device through said output hybrid, such that when said first and second quadrature returned signals are applied to said input hybrid they are combined and attenuated by said input hybrid instead of reaching said input device.

* * * * *